United States Patent [19]

Zocher

[11] 4,037,641

[45] July 26, 1977

[54] METHOD OF FABRICATING SEWING MACHINE NEEDLES

[75] Inventor: Josef Zocher, Aachen, Haaren, Germany

[73] Assignee: The Singer Company, New York, N.Y.

[21] Appl. No.: 705,860

[22] Filed: July 16, 1976

[51] Int. Cl.[2] ..... B21G 1/02

[52] U.S. Cl. ..... 163/5

[58] Field of Search ..... 163/5

[56] References Cited

U.S. PATENT DOCUMENTS 3,333,623 8/1967 Recknagel et al. ..... 163/5

3,589,428 6/1971 Masajima ..... 163/5

*Primary Examiner*—Granville Y. Custer, Jr.

*Attorney, Agent, or Firm*—Edward L. Bell; Robert E. Smith

[57] ABSTRACT

The steps in the manufacture of a sewing machine needle are disclosed in which the needle blade is shaped by first being subjected to a flow-pressing operation to form a groove with raised side flanges and thereafter the eye portion is subjected to a die pressing operation which can further raise the side flanges. The needle is then completed by eye punching, pointing, and fin removal.

4 Claims, 11 Drawing Figures

METHOD OF FABRICATING SEWING MACHINE NEEDLES

BACKGROUND OF THE INVENTION

The most commonly known method for sewing machine needle manufacture has involved the steps of cutting lengthwise grooves in the needle blade usually by a milling operation. Such known milling processes have been time consuming, the resulting sharp groove edges are detrimental to thread handling and have required elaborate finishing operations.

Cold forming techniques are also known in sewing machine needle manufacture and these pressing methods have been particularly effective to form the long groove section of needle blades. In the known processes in which the blade of the needle is pressed, the formation of the eye portion has involved milling or other cutting operations, and imposed serious limitations as to the flange dimensions which could be obtained adjacent to the eye, thus weakening the strength of the resulting needles.

SUMMARY OF THE INVENTION

It is an object of this invention to provide a method for sewing mchine needle fabricaton in which the needle shape results largely from cold pressing operations which are fast, economical, do not leave sharp groove edges, and which obviate prior weakening flange dimension limitations. This object of the invention is attained by the method of the present invention in which a sewing machine needle is fabricated from a cylindrical metal blank by the steps of swaging the blank into a cylindrical butt portion and a cylindrical blade portion of smaller diameter extending from the butt portion to a free extremity, flow pressing a continuous groove in the blade portion to closely adjacent the free extremity, then placing the flow pressed blade portion between cold working dies and pressing an eye portion therein including an eye accommodating web closely adjacent to the free extremity, and then finishing the needle by punching an eye in the eye accommodating web and forming a point at the free extremity of the blade.

DETAILED DESCRIPTION

Figure 1:
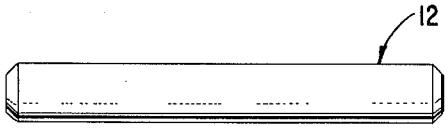
FIG. 1 illustrates a blank of cylindrical stock suitable for the formation of a needle by the method of this invention.
Figure 3:
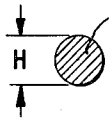
FIG. 3 is a cross-sectional view through the swaged needle shank taken substantially along line 3—3 of FIG. 2 and drawn at twice the scale thereof.
Figure 2:
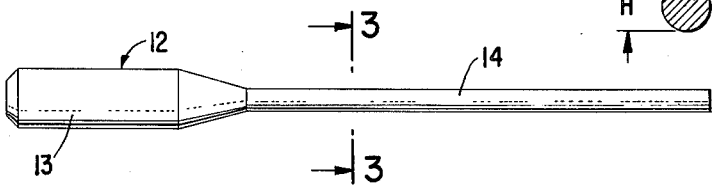
FIG. 2 shows the blank after the needle shank has been swaged.

Referring to the accompanying drawing, FIG. 1 illustrates a cylindrical metal blank 12 suitable for the ultimate fabrication of a sewing machine needle by the operation of the method of this invention. FIG. 2 illustrates the shape of the blank 12 after it has been subjected to a swaging operation in which the blank 12 has been divided into a cylindrical butt portion 13 and a coaxial blade portion 14 of smaller diameter than the butt portion. FIG. 3 illustrates, at twice the scale, the cross-sectional shape of the swaged blade portion 14 and on FIG. 3, the diameter of the blade portion is indicated at H.

Figure 4:
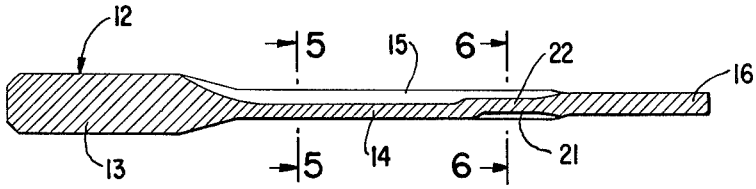
FIG. 4 is a lengthwise cross-sectional view of the blank after the long groove therein has been flow pressed.
Figure 5:
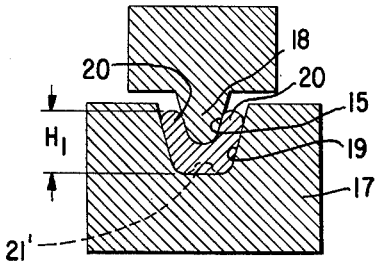
FIG. 5 is a cross-sectional view through the needle shank taken substantially along 5—5 of FIG. 4, drawn at twice the scale thereof, and including a cross-sectional representation of flow pressing dies suitable for forming the long groove.
Figure 6:
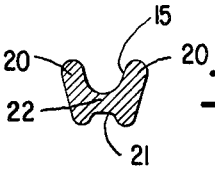
FIG. 6 is a corss-sectional view through the eye portion of the needle shank taken substantially along line 6—6 of FIG. 4, and drawn at twice the scale thereof.

FIG. 4 is a lengthwise cross-sectional view of the swaged needle blank 12 after the blade portion 14 has been subjected to a flow pressing operation. By this flow pressing operation, a continuous long groove 15 is formed lengthwise in the needle blade from the butt portion 13 to a point adjacent to the free extremity 16 of the needle blade. FIG. 5 includes a representation of the cross-sectional configuraton of the flow pressing dies 17 and 18 and it can be noted from FIG. 5 that the space between the needle blade accommodating cavity 19 in the bottom die 17 and the groove forming upper die 18 provides an excess of space for the cross-sectional area occupied by the needle blade so that room is provided for the needle blade to flow into the excess space between the dies 17 and 18.

It is to be noted that with this flow pressing operation, the groove 15 causes the metal of the blank to flow and causes flanges 20—20 to be raised one at each side of the groove 15. This deformation of the needle blade is occasioned without the formation of any fins and the height of the flanges 20 can be made to be equal to or up to 10–15% higher than the diameter H of the swaged blade portion 14 of the blank 12.

Near the free extremity 16 of the needle blank, a shallow short groove 21 may be formed opposite the long groove 15 by including a suitable short groove forming projection 21′ in the bottom die 17.

It is pointed out that a web 22 which extends between the long groove 15 and the short groove 21 is preferrably thicker than is practical to accommodate eye punching tools. The thick web 22 is purposely formed in order to provide for a gradually rounded border 23 at the ends of the eye is eventually formed in the needle.

Figure 7:
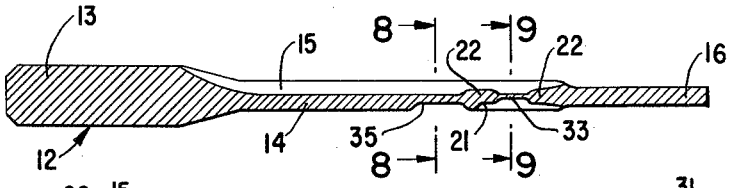
FIG. 7 is a lengthwise cross-sectional view of the needle blank after the eye portion has been die pressed.
Figure 9:
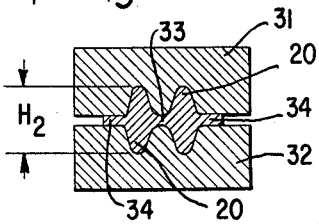
FIG. 9 is a cross-sectional view through the eye portion of the needle shank taken substantially along line 9—9 of FIG. 7, drawn at twice the scale thereof, and including a cross-sectional view representation of die pressing dies suitable for finished shaping the eye portion.

FIG. 7 is a lengthwise cross-sectional view of the needle blank after a further cold pressing operation has been performed on that portion 30 of the blade which will eventually cccommodate the eye. This further cold pressing operation may be accomplished using fin producing dies 31, 32 as shown in FIG. 9. FIG. 9 shows that the die pressing operation can spread the flanges 20—20, and form an eye accommodating web 33 sufficiently thin as to be easily pierced by an eye punch. In the die pressing operation the height $H_2$ of the flanges 20 alongside the eye accommodating web 33 can be made equal to $H_1$ or as much as 10–15% higher than H of the swaged blade diameter. Fins 34 will be formed by the dies 31, 32.

Figure 8:
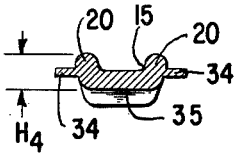
FIG. 8 is a cross-sectional view through the needle shank taken substantially along line 8—8 of FIG. 7 and drawn at twice the scale thereof.

FIG. 8 illustrates the preferable cross-sectional shape of the needle blade in the transition zone immediately above the eye. Preferably this shape is imparted by the same fin producing dies 31 and 32 as are used to shape the eye portion 30, however, the transition zone includes a scarf 35 which provides a clearance above the needle eye so that a sewing machine loop taker has clearance to pass closer to the needle blade centerline better to seize a thread loop from the needle. As a result the flanges 20 in the transition zone as shown in FIG. 8 are noticably less in height $H_4$ than are the flanges 20 at other points. These variations in flange heights $H_1$, $H_2$, and $H_4$ are all accomplished without the need for cutting, milling or other machining operations. At the transition zone shown in FIG. 8, fins 34 are also formed.

Figure 10:
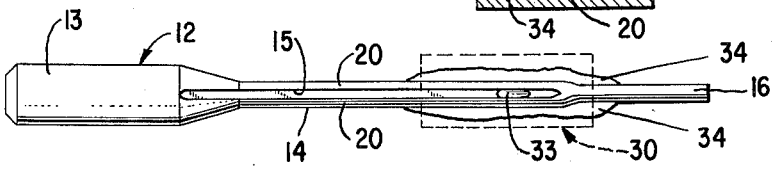
FIG. 10 is a elevational view of the needle blank of FIG. 7 as viewed from the long groove side.
Figure 11:
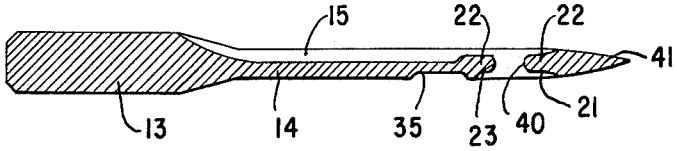
FIG. 11 is a lengthwise cross-sectional view of the finished needle.

FIG. 10 illustrates the needle blank in elevation viewed from the long groove side after the two successive cold forming operations described above.

In order to finish the needle illustrated in FIG. 10 three operations are required, eye punching to form a through eye 40, a point forming operation to form the point 41, and a fin removal operation to remove the exterior fins 34.

Since the eye-accommodating web 33 may be formed exceedingly thin by the die pressing operation illustrated in FIG. 9 without reducing the web 22, the eye 40 may be formed very easily by any conventional eye punching tools and very low punch wear will be occasioned. Furthermore, the relatively thick web portion 22 will avoid thin sharp edges bordering the needle eye 40.

The needle pointing may be accomplished as by grinding and fin removal may also be accomplished by grinding. Fin removal is facilitated since the fins 34 occur principally exteriorly on the needle blade, and therefore, eye stringing or other means of eye smoothening are obviated.

This invention thus provides a fast economical method for producing strong serviceable sewing machine needles in which two principal operations are the successive flow pressing and die pressing steps which, other than eye punching and pointing, determine the finished shape of the needle blade. Using the method of this invention, therefore, great uniformity of dimension and form is attained in the resulting needles.

Having thus set forth the nature of this invention, what is claimed herein is:

1. The method of forming a sewing machine needle having a cylindrical butt portion and a cylindrical blade portion of smaller diameter extending from said butt portion to a free extremity, comprising the steps of flow pressing a continuous groove in said blade portion extending from said butt portion to closely adjacent the free extremity thereof, shaping parallel side flanges at opposite sides of the groove in said blade portion in said flow pressing operation which parallel side flanges have a height dimension at least equal to the diameter of said cylindrical blade portion, die pressing an eye portion including an eye-accommodating web in said grooved blade portion closely adjacent to the free extremity thereof, modifying the shape of said parallel side flanges in said eye portion by said die pressing operation without reducing said height dimension, punching an eye in said eye-accommodating web, and forming a point at the free extremity of said blade portion.

2. The method of forming a sewing machine needle as set forth in claim 1, which includes the steps of shaping parallel side flanges at opposite sides of the groove in said blade portion in said flow pressing operation, which parallel side flanges have a height dimension which is greater than the diameter of said cylindrical blade portion, and modifying the shape of said parallel side flanges in said eye portion by said die pressing operation so as to increase said height dimension.

3. The method of forming a sewing machine needle from a cylindrical metal blank comprising, swaging said blank into a cylindrical butt portion and a cylindrical blank portion of smaller diameter extending from said butt portion to a free extremity, subjecting said blade portion to a flow pressing operation and forming a finless V-shaped groove thereby which extends from said butt portion to a point closely adjacent to the free extremity thereof, forming an eye portion on said needle blade portion by subjecting only a fraction of said grooved blade portion to a fin producing die pressing operation and forming an eye accommodating web thereby, punching an eye in said eye-accommodating web, forming a point at the free extremity of said blade portion, and removing the fins produced by the die pressing operation.

4. The method of forming a sewing machine needle as set forth in claim 3 which includes the step of forming during said die pressing operation a transition zone joining the finless V-shaped groove with the eye accommodating web and having a shallow height providing a clearance above the needle eye.

* * * * *

UNITED STATES PATENT OFFICE

CERTIFICATE OF CORRECTION

PATENT NO. : 4,037,641

DATED : July 26, 1977

INVENTOR(S) : Josef Zocher

It is certified that error appears in the above-identified patent and that said Letters Patent are hereby corrected as shown below:

Column 1, line 19, after "operations," insert -- required a large number of finishing operations, --

Column 1, line 26, "mchine" should be -- machine --

Column 1, line 64, "corss" should be -- cross --

Column 2, line 60, after "eye" insert -- when the eye --

Signed and Sealed this

*First* Day of *November 1977*

[SEAL]

*Attest:*

RUTH C. MASON
*Attesting Officer*

LUTRELLE F. PARKER
*Acting Commissioner of Patents and Trademarks*